US007727914B2

(12) United States Patent
Chiou

(10) Patent No.: US 7,727,914 B2
(45) Date of Patent: Jun. 1, 2010

(54) FLEXIBLE PENETRATION RESISTANT ARTICLE

(75) Inventor: Minshon J. Chiou, Chesterfield, VA (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 152 days.

(21) Appl. No.: 11/990,286

(22) PCT Filed: Aug. 8, 2006

(86) PCT No.: PCT/US2006/031007

§ 371 (c)(1),
(2), (4) Date: Feb. 7, 2008

(87) PCT Pub. No.: WO2008/016362

PCT Pub. Date: Feb. 7, 2008

(65) Prior Publication Data

US 2009/0098356 A1 Apr. 16, 2009

Related U.S. Application Data

(60) Provisional application No. 60/707,199, filed on Aug. 10, 2005.

(51) Int. Cl.
*B32B 27/12* (2006.01)
*B32B 27/02* (2006.01)

(52) U.S. Cl. ..... 442/134; 442/135; 442/164; 428/911; 89/36.01; 89/36.02; 89/36.05; 2/2.5

(58) Field of Classification Search ..... 442/134, 442/135, 164; 89/36.01, 36.02, 36.05; 428/911; 2/2.5
See application file for complete search history.

(56) References Cited

U.S. PATENT DOCUMENTS

| | | | | |
|---|---|---|---|---|
| 4,403,012 | A | 9/1983 | Harpell et al. | |
| 7,288,493 | B2 * | 10/2007 | Bhatnagar et al. | 442/134 |
| 2004/0092183 | A1 | 5/2004 | Geva et al. | |

FOREIGN PATENT DOCUMENTS

| | | |
|---|---|---|
| WO | WO 02/084202 | 10/2002 |
| WO | WO 2004/018754 | 3/2004 |

* cited by examiner

*Primary Examiner*—Ula C Ruddock

(57) ABSTRACT

The invention relates to a flexible, penetration resistant article comprising a plurality of fibrous layers including continuous filament yarns, and having an areal density of less than about 4.4 kilograms per square meter. At least one of the plurality of fibrous layers has a fiber with a tenacity of at least about 30 grams per decitex and a continuous filament yarn having a linear density of less than about 1100 decitex.

11 Claims, No Drawings

FLEXIBLE PENETRATION RESISTANT ARTICLE

RELATED APPLICATIONS

This application claims benefit of U.S. Provisional Application No. 60/707,199, filed Aug. 10, 2005, the disclosure of which is incorporated herein by reference in its entirety.

FIELD OF THE INVENTION

The present invention relates to flexible penetration resistant articles. Preferred embodiments are particularly effective against, but not limited to, multiple handgun and fragment threats.

BACKGROUND OF THE INVENTION

Personal ballistic body armor, particularly vests and other articles, are formed generally of materials which serve to prevent penetration of a bullet or other projectile, and any other object that is forcefully applied to the armor. These articles are primarily used for the armed forces, but also have police and civilian applications.

U.S. Pat. No. 6,162,746 discloses a composite designed to be resistant to knife and ice pick stabs. The composite comprises a plurality of layers of woven polybenzoxazole (PBO) or polybenzothiazole (PBT) fibers, a plurality of layers with a tightness factor of at least 0.75, and a plurality of layers of a network fiber.

U.S. Patent Application No. 2002/0164912 is directed to a ballistic resistant fabric where the warp has at least three adjacent fibers where one fiber is of a first material and the two other adjacent fibers are of a second material. The weft has at least three other adjacent fibers where one fiber is of the first material and two other fibers adjacent to the one fiber are made of a second material. Fibers include PBO and poly (paraphenylene-terephthalamide).

U.S. Patent Application No. 2004/0216595 teaches a formed metallic armor article having a metallic facing element and a fiber composite backing portion. Fibers used in the backing portion include polyethylene, aramide, liquid crystal polymers, fiberglass, carbon, and M5®.

PCT Patent Application WO 2005/001373 discloses a ballistic resistant material that has first and second exterior layers of a ballistic resistant non-woven textile and a layer of ballistic-resistant woven textile which is placed between the first and second exterior layers.

There is a growing demand to lighten the protective equipment worn by soldiers and police offices to improve their effectiveness and maneuverability in combative environments. Existing fabric systems and articles have shown limitations in performance against both fragment and handgun bullets at weights below current levels. Thus, a need exists for light weight, penetration resistant articles that are effective against fragments and handgun bullets, among other threats.

SUMMARY OF THE INVENTION

The present invention provides flexible penetration resistant articles that are made from a plurality of fibrous layers and have an areal density of less than 4.4 kilograms per square meter. Preferred article embodiments exhibit excellent resistance to multiple handgun and fragment based threats. The articles provide greater protection at a given weight, and effective protection at a lighter weight, as compared to currently available fragment and bullet resistant body armors.

In accordance with one preferred embodiment, there has now been provided a flexible, penetration resistant article comprising a plurality of fibrous layers including continuous filament yarns, and having an areal density of less than about 4.4 kilograms per square meter, wherein at least one of the plurality of fibrous layers comprises a fiber having a tenacity of at least about 30 grams per decitex and a continuous filament yarn having a linear density of less than about 1100 decitex.

In some embodiments, the plurality of fibrous layers includes 45 layers or less. In certain embodiments, at least one of the plurality of fibrous layers comprises a polymer fiber having a tenacity of at least about 40 grams per decitex.

Suitable continuous filament yarns include polyamid fibers, polyolefin fibers, polybenzoxazole fibers, polybenzothiazole fibers, polyareneazole fibers (such as poly{2,6-diimidazo[4,5-b:4',5'-e]pyridinylene-1,4-(2,5-dihydroxy) phenylene} fibers), polypyridazole fibers, polypyridobisimidazole fibers, and mixtures thereof. In some embodiments, the plurality of fibrous layers consists essentially of polybenzoxazole fibers or polybenzothiazole fibers.

In certain embodiments of the invention, the plurality of fibrous layers includes multiple layers made from polybenzoxazole fibers or polybenzothiazole fibers and multiple layers made from aramid fibers. In yet other embodiments, the plurality of fibrous layers includes multiple layers made from polybenzoxazole fibers or polybenzothiazole fibers and multiple layers made from polyareneazole fibers, polypyridazole fibers, or polypyridobismidazole fibers. In some compositions, the plurality of fibrous layers consists essentially of polyareneazole fibers, polypyridazole fibers, or polypyridobismidazole fibers.

The plurality of fibrous layers may be woven. In other embodiments, the plurality of fibrous layers are not woven. In some embodiments where the fiber layers are woven, the at least one of the plurality of fibrous layers is woven and has a tightness factor of between about 0.2 and about 0.95.

In some aspects, the invention is directed to articles where at least one of the plurality of fibrous layers is impregnated with a polymeric matrix comprising a thermoplastic resin, a thermoset resin, or mixtures thereof.

In accordance with another preferred embodiment, there has now been provided a flexible, penetration resistant article comprising a plurality of fibrous layers including continuous filament yarns, and having an areal density of less than about 4.4 kilograms per square meter, wherein the plurality of fibrous layers collectively have a V50 value of at least about 610 meters per second against a 16-grain fragment and a V50 value of at least about 480 meters per second against a 9 millimeter handgun bullet in accordance with testing procedure MIL-STD-662E.

In accordance with yet another preferred embodiment, there has now been provided a flexible, penetration resistant article comprising a plurality of fibrous layers including continuous filament yarns, and having an areal density of less than about 4.4 kilograms per square meter, wherein the continuous filament yarns have a linear density from about 100 decitex to about 1,000 decitex, wherein at least one of the plurality of fibrous layers comprises a fiber having a tenacity of at least about 30 grams per decitex, and wherein the plurality of fibrous layers collectively have a V50 value of at least about 610 meters per second against a 16-grain fragment and a V50 value of at least about 480 meters per second against a 9 millimeter handgun bullet in accordance with testing procedure MIL-STD-662E.

In some embodiments, the invention concerns a flexible, penetration resistant article comprising a plurality of fibrous layers including continuous filament yarns, and having an areal density of less than about 4.4 kilograms per square meter, wherein the plurality of fibrous layers comprises at least an aramid fibrous layer and at least a non-aramid fibrous layer having a tenacity of at least about 30 grams per decitex and a continuous filament yarn having a linear density of less than about 1100 decitex. In certain embodiments, at least one of the plurality of fibrous layers comprises a polymer fiber having a tenacity of at least about 35 grams per decitex and having a fiber density of at least 1.6 gram per cubic centimeter.

In some embodiments, the invention concerns a method of producing a flexible, penetration resistant article comprising providing a plurality of fibrous layers including continuous filament yarns, and having an areal density of less than about 4.4 kilograms per square meter, wherein at least one of the plurality of fibrous layers comprises a fiber having a tenacity of at least about 30 grams per decitex and a continuous filament yarn having a linear density of less than about 1100 decitex.

These and various other features of novelty, and their respective advantages, are pointed out with particularity in the claims annexed hereto and forming a part hereof. However, for a better understanding of aspects of the invention, reference should be made to the accompanying descriptive matter, in which there is illustrated preferred embodiments.

DETAILED DESCRIPTION OF ILLUSTRATIVE EMBODIMENTS

The present invention may be understood more readily by reference to the following detailed description of illustrative and preferred embodiments that form a part of this disclosure. It is to be understood that the scope of the claims is not limited to the specific devices, methods, conditions or parameters described and/or shown herein, and that the terminology used herein is for the purpose of describing particular embodiments by way of example only and is not intended to be limiting of the claimed invention. Also, as used in the specification including the appended claims, the singular forms "a," "an," and "the" include the plural, and reference to a particular numerical value includes at least that particular value, unless the context clearly dictates otherwise. When a range of values is expressed, another embodiment includes from the one particular value and/or to the other particular value. Similarly, when values are expressed as approximations, by use of the antecedent "about," it will be understood that the particular value forms another embodiment. All ranges are inclusive and combinable.

Filaments of the present invention can be made from polyareneazole polymer. As defined herein, "polyareneazole" refers to polymers having either:

one heteroaromatic ring fused with an adjacent aromatic group (Ar) of repeating unit structure (a):

(a)

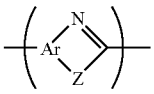

with N being a nitrogen atom and Z being a sulfur, oxygen, or NR group with R being hydrogen or a substituted or unsubstituted alkyl or aryl attached to N; or two hetero aromatic rings each fused to a common aromatic group ($Ar^1$) of either of the repeating unit structures (b1 or b2):

(b1)

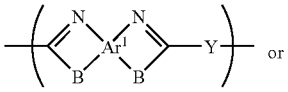

or (b2)

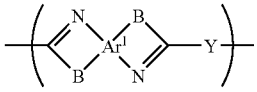

wherein N is a nitrogen atom and B is an oxygen, sulfur, or NR group, wherein R is hydrogen or a substituted or unsubstituted alkyl or aryl attached to N. The number of repeating unit structures represented by structures (a), (b1), and (b2) is not critical. Each polymer chain typically has from about 10 to about 25,000 repeating units. Polyareneazole polymers include polybenzazole polymers and/or polypyridazole polymers. In certain embodiments, the polybenzazole polymers comprise polybenzimidazole or polybenzobisimidazole polymers. In certain other embodiments, the polypyridazole polymers comprise polypyridobisimidazole or polypyridoimidazole polymers. In certain preferred embodiments, the polymers are of a polybenzobisimidazole or polypyridobisimidazole type.

In structure (b1) and (b2), Y is an aromatic, heteroaromatic, aliphatic group, or nil; preferably an aromatic group; more preferably a six-membered aromatic group of carbon atoms. Still more preferably, the six-membered aromatic group of carbon atoms (Y) has para-oriented linkages with two substituted hydroxyl groups; even more preferably 2,5-dihydroxy-para-phenylene.

In structures (a), (b1), or (b2), Ar and $Ar^1$ each represent any aromatic or heteroaromatic group.

An "aromatic" group, may be an optionally substituted aromatic 5- to 13-membered mono- or bi-carbocyclic ring such as phenyl or naphthyl. Preferably, groups containing aryl moieties are monocyclic having 5 to 7 carbon atoms in the ring. Phenyl is one preferred aryl.

A "heteroaromatic" group, as used herein, may be an aromatic 5- to 13-membered carbon containing mono- or bicyclic ring having one to five heteroatoms that independently may be nitrogen, oxygen or sulfur. Preferably, groups containing heteroaryl moieties are monocyclic having 5 to 7 members in the ring where one or two of the ring members are selected independently from nitrogen, oxygen or sulfur.

In some embodiments, aryl or heteroaromatic moieties may be optionally substituted. Substituents include one or more of $C_1$-$C_6$ alkyl, halogen, hydroxyl, $C_1$-$C_6$ alkoxy, CN, —$NO_2$, amino, $C_1$-$C_6$ alkylamino, dialkylamino of 1-6 carbon atoms per alkyl group, thio, $C_1$-$C_6$ alkylthio, $C_1$-$C_6$ alkylsulfinyl, $C_1$-$C_6$ alkylsulfonyl, $C_2$-$C_7$ alkoxycarbonyl, $C_2$-$C_7$ alkylcarbonyl, trifluoroalkxoy, benzylnitrile and benzoyl groups.

While the aromatic or heteroaromatic group can be any suitable fused or non-fused polycyclic system, in some embodiments it is preferably a single six-membered ring. In certain embodiments, the Ar or $Ar^1$ group is more preferably heteroaromatic, wherein a nitrogen atom is substituted for one of the carbon atoms of the ring system or Ar or $Ar^1$ may contain only carbon ring atoms. In still other embodiments, the Ar or $Ar^1$ group is more preferably heteroaromatic.

As herein defined, "polybenzazole" refers to polyareneazole polymer having repeating structure (a), (b1), or (b2) wherein the Ar or $Ar^1$ group is a single six-membered aromatic ring of carbon atoms. Preferably, in some embodiments, polybenzazoles include a class of rigid rod polybenzazoles having the structure (b1) or (b2); more preferably, in some embodiments, rigid rod polybenzazoles having the structure (b1) or (b2) with a six-membered carbocyclic aromatic ring $Ar^1$. Such preferred polybenzazoles include, but are not limited to polybenzimidazoles (B═NR), polybenzthiazoles (B═S), polybenzoxazoles (B═O), and mixtures or copolymers thereof. When the polybenzazole is a polybenzimidazole, preferably, in some embodiments, it is poly(benzo[1,2-d:4,5-d']bisimidazole-2,6-diyl-1,4-phenylene). When the polybenzazole is a polybenzthiazole, preferably, in some embodiments, it is poly(benzo[1,2-d:4,5-d']bisthiazole-2,6-diyl-1,4-phenylene). When the polybenzazole is a polybenzoxazole, preferably, in some embodiments, it is poly(benzo[1,2-d:4,5-d']bisoxazole-2,6-diyl-1,4-phenylene).

As herein defined, "polypyridazole" refers to polyareneazole polymer having repeating structure (a), (b1), or (b2) wherein the Ar or $Ar^1$ group is a single six-membered aromatic ring of five carbon atoms and one nitrogen atom. Preferably, these polypyridazoles include a class of rigid rod polypyridazoles having the structure (b1) or (b2), more preferably rigid rod polypyridazoles having the structure (b1) or (b2) with a six-membered heterocyclic aromatic ring $Ar^1$. Such more preferred polypyridazoles include, but are not limited to polypyridobisimidazole (B═NR), polypyridobisthiazole (B═S), polypyridobisoxazole (B═O), and mixtures or copolymers thereof. Yet more preferred, the polypyridazole is a polypyridobisimidazole (B═NR) of structure:

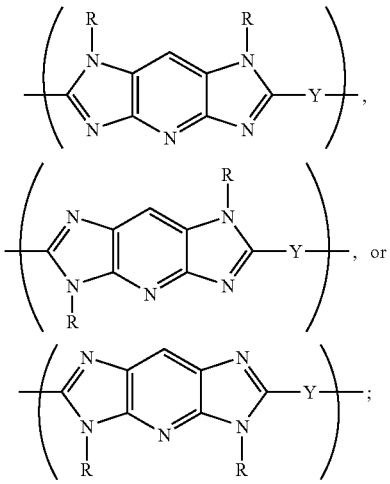

wherein N is a nitrogen atom and R is hydrogen or a substituted or unsubstituted alkyl or aryl attached to N, preferably, in some embodiments, wherein R is H. The average number of repeat units of the polymer chains is typically in the range of from about from about 10 to about 25,000, more typically in the range of from about 100 to 1,000, even more typically in the range of from about 125 to 500, and further typically in the range of from about 150 to 300.

As used herein, the phrase "functionally terminated polyareneazole oligomer" refers to a polyareneazole oligomer that has at least one reactive group at a terminal position.

As used herein, the term "oligomer" refers to a molecule having from 2 to about five covalently linked chemical units that can be the same or different.

As used herein, the term "polymer" refers to a molecule having more than about five covalently linked chemical units that can be the same or different.

The term "alkyl", as used herein, refers to a substituted or unsubstituted aliphatic hydrocarbon chain and includes, but is not limited to, straight and branched chains containing from 1 to 12 carbon atoms, preferably 1 to 6 carbon atoms, unless explicitly specified otherwise. Examples of alkyl groups include methyl, ethyl, propyl, isopropyl, butyl, i-butyl and t-butyl. Specifically included within the definition of "alkyl" are those aliphatic hydrocarbon chains that are optionally substituted. The carbon number as used in the definitions herein refers to carbon backbone and carbon branching, but does not include carbon atoms of the substituents, such as alkoxy substitutions and the like.

In certain embodiments of the invention, substituents for alkyl groups include nitro, cyano, $—N(R_x)(R_y)$, halo, hydroxyl, aryl, heteroaryl, alkoxy, alkoxyalkyl, and alkoxycarbonyl where $R_x$, and $R_y$ are each, independently, H, alkyl or aryl.

Several embodiments of the present invention are directed to articles comprising polyareneazole filaments, more specifically to polybenzazole (PBZ) filaments or polypyridazole filaments.

As used herein, certain filaments of the present invention are prepared from polyarenazole polymer, such as polybenzazole (PBZ) or polypyridazole polymer. For purposes herein, the term "filament" refers to a relatively flexible, macroscopically homogeneous body having a high ratio of length to width across its cross-sectional area perpendicular to its length. The filament cross section may be any shape, but is typically circular. The term "filament" may be used interchangeably with the term "fiber."

As herein defined, "yarn" refers to a continuous length of two or more fibers, wherein fiber is as defined hereinabove.

For purposes herein, "fabric" refers to any woven, knitted, or non-woven structure. By "woven" is meant any fabric weave, such as, plain weave, crowfoot weave, basket weave, satin weave, twill weave, and the like. By "knitted" is meant a structure produced by interlooping or intermeshing one or more ends, fibers or multifilament yarns. By "non-woven" is meant a network of fibers, including unidirectional fibers, felt, and the like.

Articles of the present invention comprise a plurality of fibrous layers. The layers can be held together or joined in any manner, such as, by being sewn together or they can be stacked together and held, for example, in a fabric envelope or carrier. The layers which form the sections can be separately stacked and joined, or all of the plurality of layers can be stacked and joined as a single unit.

The layers can also be held together by the polymeric matrix comprising a thermoset or thermoplastic resin, or mixtures thereof. A wide variety of suitable thermoset and thermoplastic resins and mixtures thereof are well known in the prior art and can be used as the matrix material. For example, thermoplastic resins can comprise one or more polyurethane, polyimide, polyethylene, polyester, polyether etherketone, polyamide, polycarbonate, and the like. Thermoset resins can be one or more epoxy-based resin, polyester-based resin, phenolic-based resin, and the like, preferably a polyvinylbutyral phenolic resin. Mixtures can be any combination of the thermoplastic resins and the thermoset resins. The proportion of the matrix material in each layer is from about 2% to about 50% by weight of the layer preferably 5% to 30% by weight of the layer.

The areal density of the fabric layer is determined by measuring the weight of each single layer of selected size, e.g., 10 cm×10 cm. The areal density of the composite structure is determined by the sum of the areal densities of the individual layers.

In some embodiments, the more preferred rigid rod polypyridazoles include, but are not limited to polypyridobisimidazole homopolymers and copolymers such as those described in U.S. Pat. No. 5,674,969. One such exemplary polypyridobisimidazole is homopolymer poly(1,4-(2,5-dihydroxy) phenylene-2,6-diimidazo[4,5-b:4'5'-e]pyridinylene). This polymer is also known using various terminology, for example: poly(1,4-(2,5-dihydroxy)phenylene-2,6-pyrido[2,3-d:5,6-d']bisimidazole); poly[(1,4-dihydroxyimidazo[4,5-b:4',5'-e]pyridine-2,6-diyl) (2,5-dihydroxy-1,4-phenylene)]; poly[(2,6-diimidazo[4,5-b:4',5'-e]pyridinylene-(2,5-dihydroxy-1,4-phenylene)]; Chemical Abstracts Registry No. 167304-74-7, poly[(1,4-dihydrodimidazo[4,5-b:4',5'-e]pyridine-2,6-diyl)(2,5-dihydroxy-1,4-phenylene)]; 2,5-dihydroxyterephthalic acid-1,2,4,5-tetraminopyridine copolymer; PIPD; pyridobisimidazole-2,6-diyl (2,5-dihydroxy-p-phenylene) copolymer; poly(1,4-(2,5-dihydroxy)phenylene-2,6-diimidazo[4,5-b:4',5'-e]pyridinylene); and poly(1,4-(2,5-dihydroxy)phenylene-2,6-pyrido[2,3-d5,6-d']bisimidazole).

The polyareneazole polymers used in this invention may have the properties associated with a rigid-rod structure, a semi-rigid-rod structure, or a flexible coil structure; preferably a rigid rod structure. When this class of rigid rod polymers has structure (b1) or (b2) it preferably has two azole groups fused to the aromatic group $Ar^1$.

Suitable polyareneazoles useful in this invention include homopolymers and copolymers. Up to as much as about 25 percent, by weight, of other polymeric material can be blended with the polyareneazole. Also copolymers may be used having as much as about 25 percent or more of other polyareneazole monomers or other monomers substituted for a monomer of the majority polyareneazole. Suitable polyareneazole homopolymers and copolymers can be made by known procedures, such as those described in U.S. Pat. Nos. 4,533,693 (to Wolfe et al. on Aug. 6, 1985), 4,703,103 (to Wolfe et al. on Oct. 27, 1987), 5,089,591 (to Gregory et al. on Feb. 18, 1992), 4,772,678 (Sybert et al. on Sep. 20, 1988), 4,847,350 (to Harris et al. on Aug. 11, 1992), 5,276,128 (to Rosenberg et al. on Jan. 4, 1994) and U.S. Pat. No. 5,674,969 (to Sikkema, et al. on Oct. 7, 1997), the entirety of each is incorporated by reference herein. Additives may also be incorporated in the polyareneazole in desired amounts, such as, for example, anti-oxidants, lubricants, ultra-violet screening agents, colorants and the like.

Polyareneazole polymers may be made by reacting a mix of dry ingredients with a polyphosphoric acid (PPA) solution. The dry ingredients may comprise azole-forming monomers and metal powders.

Exemplary azole-forming monomers include 2,5-dimercapto-p-phenylene diamine, terephthalic acid, bis-(4-benzoic acid), oxy-bis-(4-benzoic acid), 2,5-dihydroxyterephthalic acid, isophthalic acid, 2,5-pyridodicarboxylic acid, 2,6-napthalenedicarboxylic acid, 2,6-quinolinedicarboxylic acid, 2,6-bis(4-carboxyphenyl) pyridobisimidazole, 2,3,5,6-tetraminopyridine, 4,6-diaminoresorcinol, 2,5-diaminohydroquinone, 1,4-diamino-2,5-dithiobenzene, or any combination thereof. Preferably, the azole forming monomers include 2,3,5,6-tetraaminopyridine and 2,5-dihydroxyterephthalic acid. In certain embodiments, it is preferred that that the azole-forming monomers are phosphorylated. Preferably, phosphorylated azole-forming monomers are polymerized in the presence of polyphosphoric acid and a metal catalyst.

Metal powders can be employed to help build the molecular weight of the final polymer. The metal powders typically include iron powder, tin powder, vanadium powder, chromium powder, and any combination thereof.

The azole-forming monomers and metal powders are mixed and then the mixture is reacted with polyphosphoric acid to form a polyareneazole polymer solution. Additional polyphosphoric acid can be added to the polymer solution if desired. The polymer solution is typically extruded or spun through a die or spinneret to prepare or spin the filament

EXAMPLES

In the following examples, composites of a plurality of fabric layers were tested for ballistic resistance. Ballistic panels of 15 inches by 15 inches were constructed for the tests, wherein all of the fabric layers were sewn around the edges and were additionally sewn diagonally with cross-stitches. The composites had an areal density of 4.30+/−0.05 kilograms per square meter.

Aramid yarns, sold by E.I. du Pont de Nemours and Company under the trademark Kevlar® (poly(p-phenylene terephthalamide)), were included in some of the samples. The aramid yarns had a tenacity of 25.2 grams pet decitex, elongation at break of 3.8%, and modulus of 575 grams per decitex.

PBO (poly-p-phenylenebenzoisooxazole) yarns, sold by Toyobo Company, Limited, under the tradename Zylon®, were included in some of the samples. The PBO yarn had a tenacity of 37.8 grams per decitex, elongation at break of 3.5%, and modulus of 1170 grams per decitex.

Ballistic tests were conducted on the composites to determine the ballistic limit (V50) in accordance with MIL-STD-662E. The composite to be tested were placed in a sample mount with a frame and clamps to hold the sample taut and perpendicular to the path of test projectiles. The composites were tested against two different projectiles: (1) a 16-grain fragment simulator; and (2) a 9 millimeter full metal jacket handgun bullet weighing 124 grains. The first firing for each panel is for a projectile velocity estimated to be the likely ballistics limit (V50). When the first firing yields a complete sample penetration, the next firing is for a projectile velocity of about 15.2 meters per second less in order to obtain a partial penetration. On the other hand, when the first firing yields no penetration or partial penetration, the next firing is for a velocity of about 15.2 meter per second more the first firing to obtain a complete penetration. After obtaining one partial and one complete projectile penetration, subsequent velocity increases or decreases of about 15.2 meters per second are used until enough firings are made to determine the ballistics limit (V50) for each sample. The ballistics limit is calculated by finding the arithmetic mean of an equal number of at least three of the highest partial penetration impact velocities, provided that there is a difference of not more than 38.1 meters per second between the highest and lowest individual impact velocities.

Example 1

Example 1 included thirty-one fibrous layers made with 550 decitex Zylon® at 11.8 ends per centimeter in a plain weave. The sample had an areal density of about 4.3 kilograms per square meter.

Example 2

Example 2 included twenty-one fibrous layers made with 550 decitex Zylon® at 11.8 ends per centimeter in a plain weave for a striking face, and eight fibrous layers made with 660 decitex Kevlar® at 13.4 ends per centimeter in a plain weave for the body-facing side. The sample had an areal density of about 4.35 kilograms per square meter.

Comparative Example A

Comparative Example A included twenty-four layers made with 660 decitex Kevlar® at 13.4 ends per centimeter in a plain weave. The sample had an areal density of about 4.35 kilograms per square meter.

Comparative Example B

Comparative Example B included eighteen fibrous layers made with 1650 decitex Zylon® at 6.7 ends per centimeter in a plain weave. The sample had an areal density of about 4.25 kilograms per square meter.

The ballistics tests results, shown in Table I below, indicate the V50 results for the articles in accordance with the present invention (Examples 1 and 2) were significantly better than the V50 results of the comparative articles (Comparative Examples A and B).

| Sample ID | Areal Density, ($kg/m^2$) | 16-grain fragment V50 (m/sec) | 9 mm Handgun Bullet V50 (m/sec) |
|---|---|---|---|
| Example 1 | 4.30 | 619 | 517 |
| Example 2 | 4.35 | 631 | 519 |
| Comp. Ex. A | 4.35 | 576 | 476 |
| Comp. Ex. B | 4.25 | 603 | 478 |

Example 3

In Example 3, the structures of examples 1 and 2 may be replicated with a fiber selected from Polyareneazoles, Polypyridazoles, Polypyridobisimidazoles, highly oriented high molecular weight polyethylene or any combination thereof in place of the KEVLAR® fiber.

Example 4

In Example 4, the structures of examples 1 and 2 may be replicated with a fiber selected from Polyareneazoles, Polypyridazoles, Polypyridobisimidazoles, highly oriented high molecular weight polyethylene or any combination thereof in place of the ZYLON® fiber.

While the present invention has been described in connection with the preferred embodiments, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

All patents and publications disclosed herein are incorporated by reference in their entirety.

What is claimed:

1. A flexible, penetration resistant article comprising a plurality of fibrous layers including continuous filament yarns, and having an areal density of less than about 4.4 kilograms per square meter, wherein at least one of the plurality of fibrous layers comprises a fiber having a tenacity of at least about 30 grams per decitex and a continuous filament yarn having a linear density of less than about 1100 decitex;

(a) wherein the plurality of fibrous layers includes multiple layers made from polybenzoxazole fibers or polybenzothiazole fibers and multiple layers made from polyareneazole fibers, polypyridazole fibers, or polypyridobismidazole fibers; or wherein the plurality of fibrous layers consists essentially of polyareneazole fibers, polypyridazole fibers, or polypyridobismidazole fibers; and (b) wherein the continuous filament yarns are selected from the group comprising polyamid fibers, polyolefin fibers, polybenzoxazole fibers, fibers polyareneazole fibers, polypyridazole fibers, polypyridobisimidazole fibers, and mixtures thereof.

2. The article of claim 1, wherein the article has a V50 value of at least about 610 meters per second against a 16-grain fragment and a V50 value of at least about 480 meters per second against a 9 millimeter handgun bullet in accordance with testing procedure MIL-STD-662E.

3. The article of claim 1, wherein the plurality of fibrous layers includes 45 layers or less.

4. The article of claim 1, wherein at least one of the plurality of fibrous layers comprises a polymer fiber having a tenacity of at least about 40 grams per decitex.

5. The article of claim 1, wherein the plurality of fibrous layers includes multiple layers made from polybenzoxazole fibers or polybenzothiazole fibers and multiple layers made from aramid fibers.

6. The article of claim 1, wherein the plurality of fibrous layers includes multiple layers made from polybenzoxazole fibers or polybenzothiazole fibers and multiple layers made from polyareneazole fibers, polypyridazole fibers, or polypyridobismidazole fibers.

7. The article of claim 1, wherein the plurality of fibrous layers consists essentially of polyareneazole fibers, polypyridazole fibers, or polypyridobismidazole fibers.

8. The article of claim 1, wherein the at least some of the plurality of fibrous layers are not woven.

9. The article of claim 1, wherein none of the plurality of fibrous layers are woven.

10. The article of claim 1, wherein at least one of the plurality of fibrous layers is woven and has a tightness factor of between about 0.2 and about 0.95.

11. The article of claim 1, wherein at least one of the plurality of fibrous layers is impregnated with a polymeric matrix comprising a thermoplastic resin, a thermoset resin, or mixtures thereof.

* * * * *